US010451269B2

(12) United States Patent
Bowin

(10) Patent No.: US 10,451,269 B2
(45) Date of Patent: Oct. 22, 2019

(54) SYSTEM AND METHOD FOR SUPPORTING A BOILER LOAD

(71) Applicant: GENERAL ELECTRIC TECHNOLOGY GMBH, Baden (CH)

(72) Inventor: Dennis Irvin Bowin, Windsor, CT (US)

(73) Assignee: General Electric Company, Schenectady, NY (US)

( * ) Notice: Subject to any disclaimer, the term of this patent is extended or adjusted under 35 U.S.C. 154(b) by 122 days.

(21) Appl. No.: 15/075,710

(22) Filed: Mar. 21, 2016

(65) Prior Publication Data

US 2017/0268767 A1 Sep. 21, 2017

(51) Int. Cl.
*F22B 37/20* (2006.01)
*F22B 37/24* (2006.01)

(52) U.S. Cl.
CPC ..... *F22B 37/208* (2013.01); *F22B 37/244* (2013.01)

(58) Field of Classification Search
CPC ..... F22B 37/24; F22B 37/242; F22B 37/244; F22B 37/246; F22B 37/248; F16L 3/2056; G21C 13/024
See application file for complete search history.

(56) References Cited

U.S. PATENT DOCUMENTS 1,893,295 A * 1/1933 Le Bailly ..... F16L 3/2056 248/586
2,786,106 A * 3/1957 Van Ackeren ..... C10B 41/04 200/61.44
3,118,643 A * 1/1964 Suozzo ..... F16L 3/2056 248/589
3,814,063 A * 6/1974 Bijmholt ..... F22B 37/208 122/510
4,055,329 A * 10/1977 Hammond ..... B66F 3/12 254/126
4,059,075 A 11/1977 Ssinegurski et al.
4,286,549 A * 9/1981 Eisinger ..... F22B 37/244 122/510

(Continued)

FOREIGN PATENT DOCUMENTS

CN 201558738 U 8/2010
CN 202054586 U 11/2011

(Continued)

OTHER PUBLICATIONS

Moo-Zung Lee, "A Primer on Pipe supports", http://www.machinedesign.com/hydraulics/primer-pipe-supports, Aug. 28, 2013.*

(Continued)

*Primary Examiner* — Steven S Anderson, II
(74) *Attorney, Agent, or Firm* — Frank A. Landgraff

(57) ABSTRACT

A support system for a boiler includes a plurality of support assemblies arranged intermediate a ground surface and the boiler. Each of the support assemblies include a first support leg having a lower end operatively connected to the ground surface and an upper end operatively connected to the boiler, a second support leg having a lower end operatively connected to the ground surface and an upper end operatively connected to the boiler, and at least one spring operatively connected to the first support leg and the second support leg and extending generally horizontally between the first support leg and the second support leg.

17 Claims, 7 Drawing Sheets

(56) References Cited

U.S. PATENT DOCUMENTS

| | | | | |
|---|---|---|---|---|
| 4,589,621 | A * | 5/1986 | Hunt | F16M 11/10 248/421 |
| 4,940,025 | A * | 7/1990 | Ott | F22B 37/248 122/510 |
| 5,557,901 | A | 9/1996 | Hoosic et al. | |
| 2008/0271686 | A1* | 11/2008 | Radke | F22B 37/24 122/510 |

FOREIGN PATENT DOCUMENTS

| | | | |
|---|---|---|---|
| GB | 2 098 707 | A | 11/1982 |
| WO | 1998028573 | A1 | 7/1998 |

OTHER PUBLICATIONS

International Search Report and Written Opinion issued in connection with corresponding PCT Application No. PCT/EP2017/056288 dated Jun. 26, 2017.

* cited by examiner

SYSTEM AND METHOD FOR SUPPORTING A BOILER LOAD

BACKGROUND

Technical Field

Embodiments of the invention relate generally to power generation systems and, more particularly, to a system and method for supporting a boiler load.

Discussion of Art

Steam boiler plants generally have large furnaces which are commonly constructed of a number of water-cooled tubes welded in side-by-side arrangement to form gas tight tube banks forming the walls of the furnace. Boilers may be supported from the bottom, middle, or top depending on, for example, the particular application and the size of the boiler. Typically, package boilers, pre-engineered oil- and gas-fired boilers, and solid fuel-fired boilers up to about 60 tph can be bottom-supported. In a bottom-support design, a supporting structure is utilized to support the weight of the boiler from below, and expansion of the boiler pressure parts and hot structural parts occurs upward.

Beyond a certain size, however, top-support designs are typically employed. In particular, as boiler size is increased, differential expansion of the pressure parts and hot structural parts and the weight of the boiler increases, making it cheaper to adopt top support. Top-support designs can be likened to a church bell, whereby all pressure parts and other components are suspended from structural members (e.g., girders) of the steam generating plant. In top-support designs, as the furnace approaches operating temperature, the furnace walls expand vertically downward.

In all boilers, pressure excursions within the furnace (i.e., either an increase or a decrease in pressure within the furnace) cause a resultant additional flexing of the tube walls either inwardly or outwardly in a horizontal direction. It has therefore become customary and necessary to provide an arrangement of flanged girder beams, typically referred to as buckstays, that extend around the furnace to provide additional support to the furnace walls and prevent substantial movement of the furnace walls in a horizontal direction as affected by pressure differential.

Typically, these buckstays are disposed in bands around the perimeter of the furnace walls at vertically spaced intervals throughout the height of the furnace. Horizontally, the buckstays on opposite walls of the furnace are interconnected through buckstay ties so that the reactions of one buckstay are resisted by the reactions of the buckstay on the opposing wall so as to counteract the pressure forces acting on the furnace walls. Vertically, it has been customary to provide vertical support members to interconnect each buckstay to its upper and lower neighbors with a connection that permits a sliding action which is required due to relative movement between the furnace tube walls to which each buckstay is connected and the buckstays themselves.

Certain boiler applications require that the bottom of the furnace serve as a storage hopper for bottom ash accumulation. As will be readily appreciated, such accumulation and storage of bottom ash at the bottom of the furnace creates a large live load on the boiler, which contributes to additional difficulties in the design and construction of buckstays and pressure parts.

Existing solutions to account for the weight of accumulated bottom ash have been to beef up the furnace buckstay system and top supporting members (e.g., building framework, pressure part hangers, pressure part support straps, etc.). These methods, however, can costly, difficult to implement, especially where the capacity for substantial bottom ash accumulation is desired. For example, existing methods for providing additional support for top-supported boilers may no longer be adequate for large boilers in which a large amount of bottom ash storage capacity is desired.

BRIEF DESCRIPTION

In an embodiment, a support system for a boiler is provided. The system includes a plurality of support assemblies arranged intermediate a ground surface and the boiler. Each of the support assemblies include a first support leg having a lower end operatively connected to the ground surface and an upper end operatively connected to the boiler, a second support leg having a lower end operatively connected to the ground surface and an upper end operatively connected to the boiler, and at least one spring operatively connected to the first support leg and the second support leg and extending horizontally between the first support leg and the second support leg.

In another embodiment, a support assembly for a boiler is provided. The support assembly includes a first support member extending vertically between a ground surface and the boiler, a second support member extending vertically between the ground surface and the boiler and spaced from the first support member, and at least one spring extending intermediate the first support member and the second support member.

In yet another embodiment of the invention, a method for supporting a boiler load is provided. The method includes the steps of arranging a first support leg between a ground surface and the boiler, arranging a second support leg between the ground surface and the boiler, and interconnecting the first and second support leg with a variable spring.

DRAWINGS

The present invention will be better understood from reading the following description of non-limiting embodiments, with reference to the attached drawings, wherein below:

DETAILED DESCRIPTION

Figure 1:
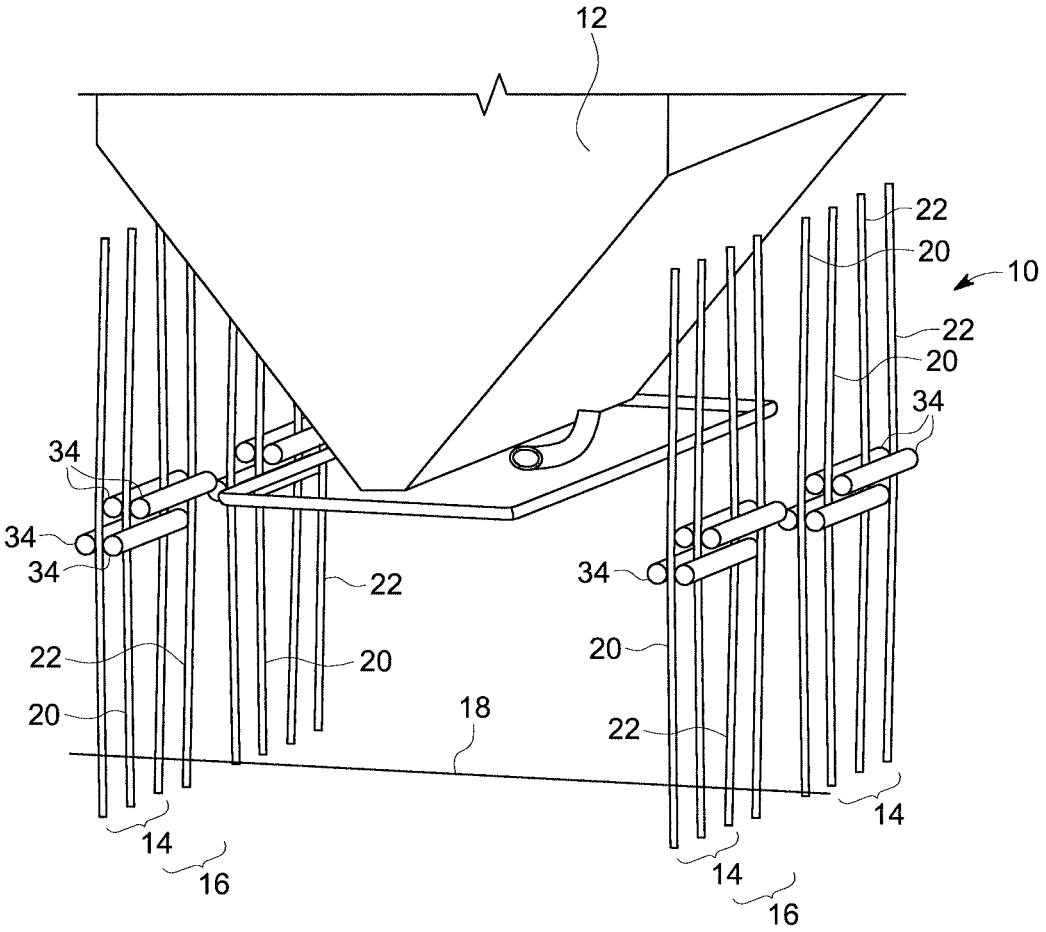
FIG. 1 is a perspective view of a support system for a boiler, according to an embodiment of the invention.

Reference will be made below in detail to exemplary embodiments of the invention, examples of which are illustrated in the accompanying drawings. Wherever possible, the same reference characters used throughout the drawings refer to the same or like parts. While embodiments of the invention are suitable for use in connection with top-supported boilers, embodiments of the invention may be utilized to provide redundant or auxiliary support for middle- or girdle-supported, or bottom supported boilers. Moreover, embodiments of the invention may also be utilized to provide bolstering support for other apparatuses, components and devices, in addition to boilers and, indeed, in any application where loads may vary.

As used herein, "operatively coupled" refers to a connection, which may be direct or indirect. The connection is not necessarily a mechanical attachment. As used herein, "top-supported" refers to a component(s), assembly or apparatus that is supported from the top (e.g., suspended from a support located above). As used herein, "middle- or girdle-supported" refers to such component(s), assembly or apparatus that is supported at some mid point of such component(s), assembly or apparatus. As used herein, "bottom-supported" refers to such component(s), assembly or apparatus that is supported from below.

Embodiments of the invention relate to a system and method for supporting a boiler load from below. Referring to FIG. 1, a support system 10 for a boiler 12 according to an exemplary embodiment is illustrated. While the boiler 12 supported by the system 10 is described herein as being a top-supported boiler (i.e., it is suspended from a support means located thereabove and permitted to expand downwardly under weighted or thermal load), the support system 10 may also be used in connection with a middle-support and even bottom-supported boiler without departing from the broader aspects of the present invention.

As shown in FIG. 1, the system 10 includes a plurality of support assemblies 14, 16 arranged beneath the boiler 12 in nested pairs, as discussed in detail hereinafter. The support assemblies 14, 16 extend from a ground surface 18 to the boiler 12 or other component attached to the boiler 12, such as a buckstay. In an embodiment, the support assemblies 14, 16 may be arranged in opposing rows beneath the boiler 12, as illustrated in FIG. 1.

Figure 2:
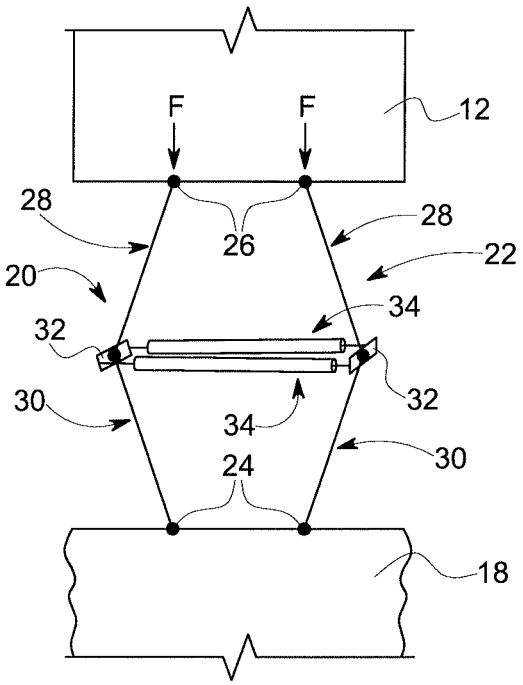
FIG. 2 is a simplified, schematic illustration of a single support assembly of the support system of FIG. 1.

With reference to FIG. 2, a simplified illustration of a single support assembly 14 is shown (support assemblies 16 being substantially identical in configuration). Each support assembly 14 includes a first support leg/member 20 and a second support leg/member 22 spaced from the first support leg 20. Each support leg 20, 22 has a lower end 24 operatively connected to the ground surface 18 and an upper end 26 operatively connected to the boiler 12. The legs 20, 22 may be connected to the ground surface 18 and boiler 12 via any means known in the art that allows slight pivotal movement of the legs 20, 22 at the connection point.

As best illustrated in FIG. 2, each support leg 20, 22 is actually a two-piece part, having an upper strut 28 and a lower strut 30 that are pivotally coupled to one another at their respective distal ends (a midpoint along each leg 20, 22) by a mounting block or bracket 32. In an embodiment, the upper and lower struts 28, 30 are substantially equal in length, although in some embodiments the struts 28, 30 may differ in length. In an embodiment, the struts 28, 30 are each approximately 9,014 inches in length and are formed from a length of 8-inch diameter metal pipe. As further shown in FIG. 2, a pair of springs 34 extend between the mounting blocks 32 of each leg 20, 22 and effectively tether the support legs 20, 22 of the support assembly 14 to one another. The springs 34 are coupled to opposed ends of the mounting block 32 and extend substantially horizontally between the blocks 32 of the respective support legs 20, 22.

Figure 3:
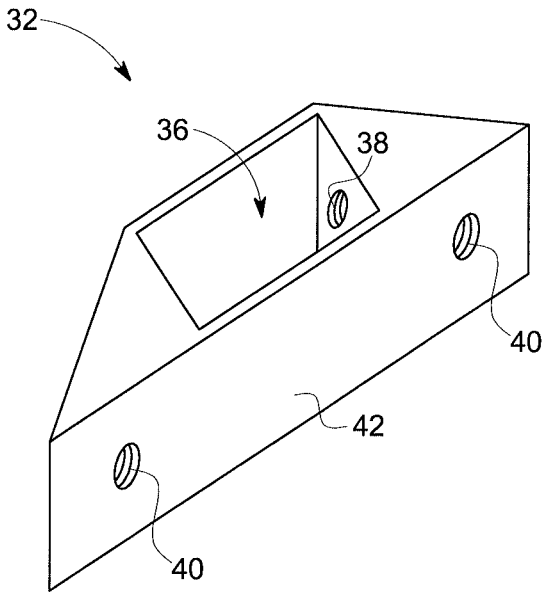
FIG. 3 is a perspective view of a mounting block of the support assembly of FIG. 1.
Figure 4:
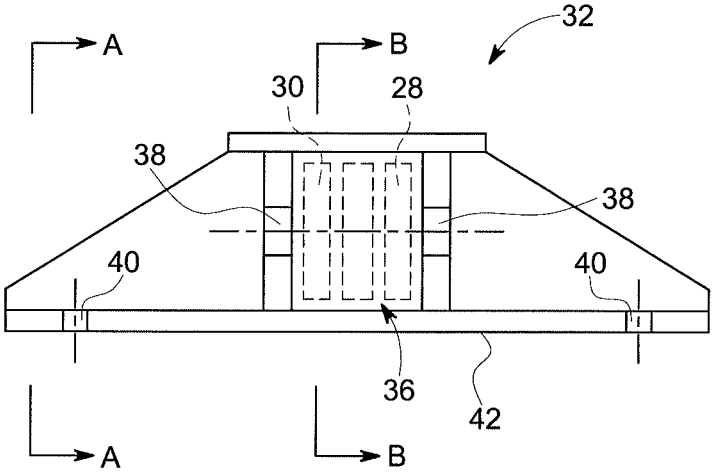
FIG. 4 is a top plan view of the mounting block of FIG. 3.
Figure 5:
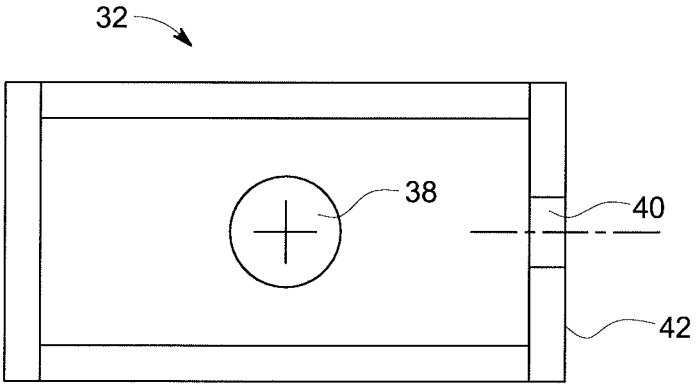
FIG. 5 is a partial cross-sectional view of the mounting block, taken along line A-A of FIG. 4.
Figure 6:
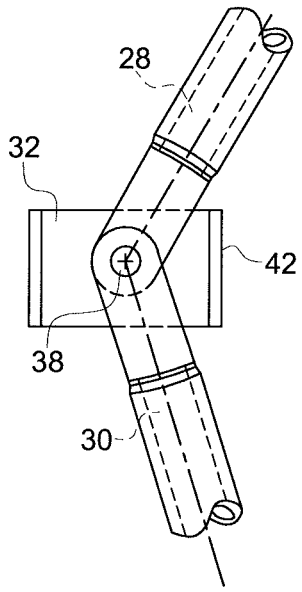
FIG. 6 is a partial cross-sectional view of the mounting block, taken along line B-B of FIG. 4.

Referring to FIGS. 3-6, the configuration of the mounting block 32 and the manner of connection of the upper strut 28, lower strut 30 and springs 34 with the mounting block 32 are more clearly illustrated. As shown in FIGS. 3 and 4, the mounting block 32 is an elongated member having an open central portion 36 configured to receive the opposed distal ends of the upper and lower struts 28, 30 of one of the support legs (such as support leg 20) therein. Opposed lateral sides of the central portion 36 have apertures 38 configured to receive a threaded bolt or like fastener therethrough to pivotally secure the upper and lower struts 28, 30 to the mounting block 32. For example, as best shown in FIG. 6, the distal ends of the upper and lower struts 28, 30 may be formed as a flat plate having an aperture therethrough. The apertures in the ends of the struts 28, 30 may be aligned with the apertures 38 in the central portion 36 of the mounting block 32, and a suitable fastener (e.g., a threaded fastener or pin) may be passed through the apertures in order to secure the mounting block 32 and struts 28, 30 to one another. By way of this connection, the upper and lower struts 28, 30 are permitted to pivot relative to one another about the pin (not shown).

As also shown in FIGS. 3, 4 and 5, the mounting block 32 has a pair of opposed apertures 40 in a front face 42 thereof which are utilized to secure the springs 34 to the mounting block 32. In an embodiment, the apertures 40 are threaded apertures configured to receive a corresponding threaded portion of the springs 34, as discussed in detail hereinafter.

Figure 7:
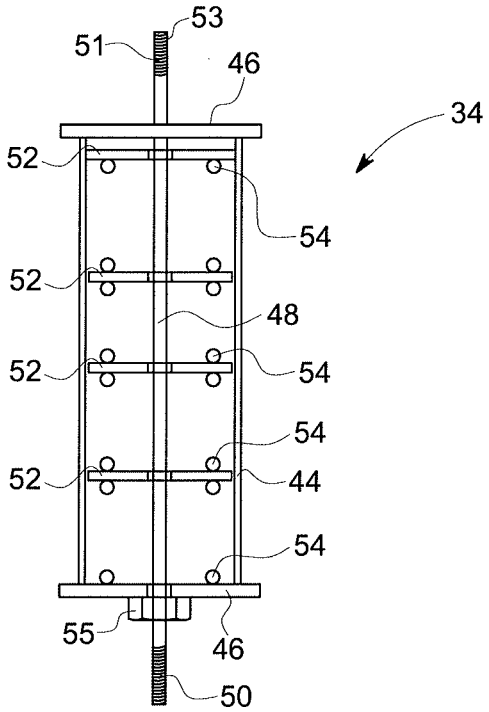
FIG. 7 is a cross-sectional illustration of a spring of the support assembly of FIG. 1.

Turning now to FIG. 7, a cross-sectional illustration of the spring 34 is shown. In an embodiment, the spring 34 is a variable spring that may have any configuration generally known in the art. In an embodiment, the spring 34 includes a cylindrical body 44 having end plates 46 fastened to the body 44 at opposed ends thereof. A rod 48 extends through an aperture formed in one of the end plates 46 and into the cylindrical body 44, and terminates just short of the opposing end plate 46. As illustrated in FIG. 7, the end of the rod 48 includes a threaded portions 50 configured to be received by the corresponding threaded apertures 40 in the mounting block 32, as discussed above. An opposite end of the spring 34 includes a second rod 51 attached to the end plate 46 with another threaded portion 53 likewise configured to be received by the threaded apertures 40 in the mounting block 32, enabling mounting of the spring 34. The interior of the pipe 44 is divided into a plurality of distinct sections by interior plates or baffles 52. Within each section is arranged a coil spring 54. In an embodiment, the cylindrical body 44 is a 24-inch (610 mm) diameter metal pipe having a length of approximately 211 inches (5360 mm), and the rod is a 2-inch (50 mm) metal rod. In an embodiment, the coil springs 54 are approximately 60 inches in height, when uncompressed. As also shown in FIG. 7, a nut 55 is provided that allows the springs 54 within the compartments to be selectively compressed.

Figure 8:
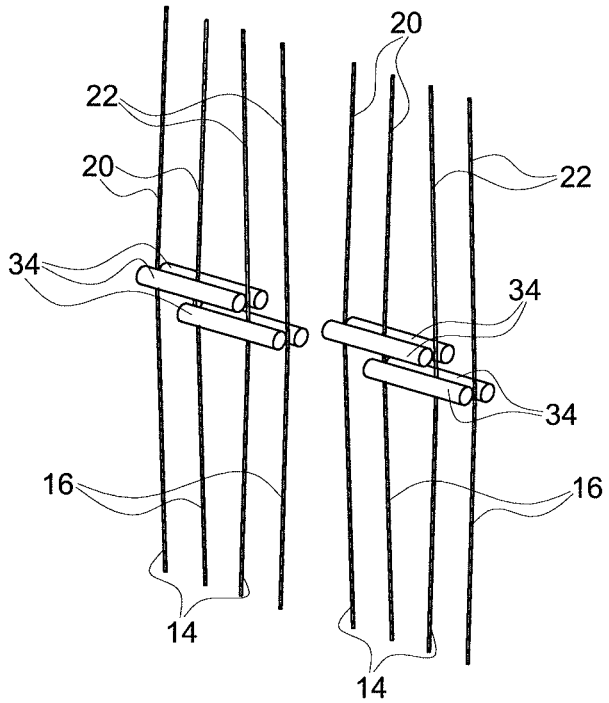
FIG. 8 is a detail, perspective view of a portion of the support system of FIG. 1, illustrating nesting of various support assemblies.

Referring back to FIG. 1, and with further reference to FIG. 8, the nested configuration of the support assemblies 14, 16 is shown. In the nested configuration, the support assemblies 14, 16 overlap one another such that, for example, the first support leg 20 of the second support assembly 16 is received between the springs 34 of the first support assembly 14 (i.e., between the first and second legs 20, 22 of the first support assembly 14). In this configuration, the second support leg 22 of the first support assembly 14 is likewise received between the springs 34 of the second support assembly 16 (i.e., between the first and second legs 20, 22 of the second support assembly 16). To facilitate this nesting arrangement, the springs 34 of the second support assembly 16 may be positioned at a vertical height that is different from the vertical height of the springs 34 of the first support assembly 14, as shown in FIGS. 1 and 8. This nested arrangement permits double the number of support assemblies to be positioned beneath the boiler 12 than would otherwise be possible utilizing a non-nested arrangement, thereby providing twice the support than such non-nested arrangement.

Figure 9:
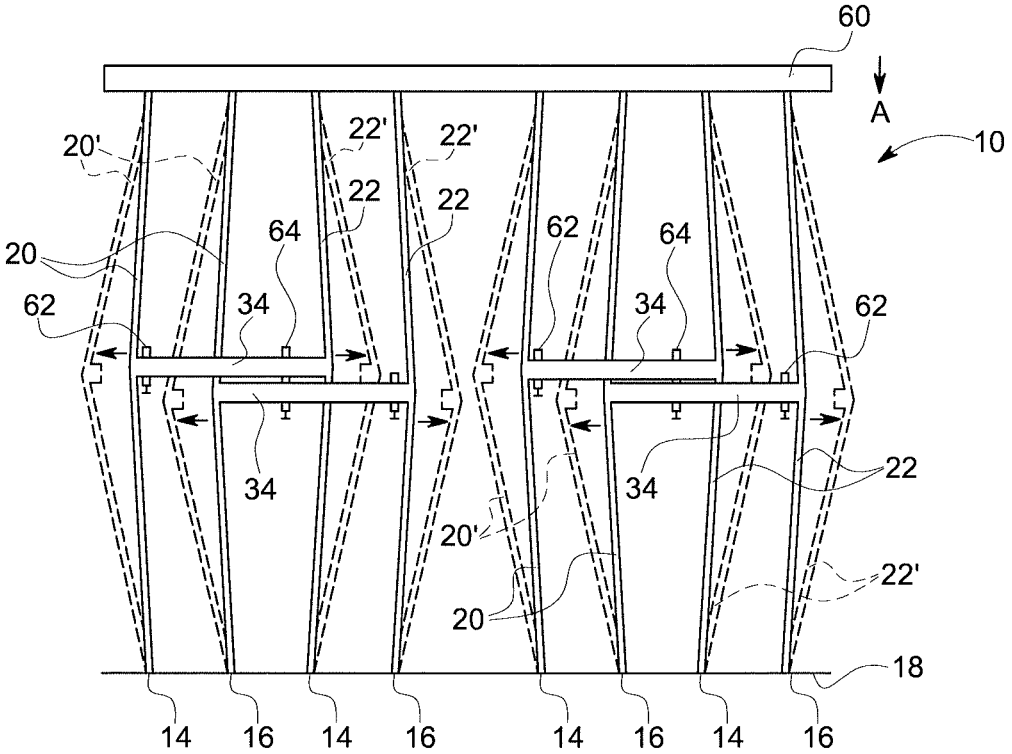
FIG. 9 is a simplified, side elevational view of the support system of FIG. 1, illustrating the system in unloaded and loaded conditions.

Turning now to FIG. 9, operation of support system 10 is illustrated. As shown therein, the support system 10 is arranged between the ground surface 18 and the boiler and is operatively connected to the boiler such as, for example, to a buckstay 60 of the boiler. The support system 10 functions to provide auxiliary or bolstering support from below, while the top supports provide support for the weight of the boiler from above (or middle supports wherein the boiler is a middle-supported boiler). In particular, the struts 28, 30 of each support leg 20, 22 provide support to the boiler through the buckstay 60, which may be needed to support added weight due to, for example, the accumulation of bottom ash in the bottom of the boiler. The support system 10 may be retrofit onto existing top- or middle-supported boilers to provide bolstering support where it is desired to store more bottom ash within the boiler (which increases the weight/load that must be carried).

In connection with the above, during boiler operation, temperatures within the boiler may increase significantly, leading to downward thermal expansion of the boiler and components thereof in the direction of arrow A. This thermal expansion has heretofore ruled out the possibility of providing bolstering support to top-supported boilers from below, as free downward thermal expansion must be permitted. The support system 10 of the invention, however, does permit downward thermal expansion while at the time maintains bolstering load support from below. In particular, as thermal expansion causes the boiler (or various components thereof) to expand downwardly in the direction of arrow A, the first and second support assemblies 14, 16 compress and move from the respective positions shown in the solid lines, to the positions represented by the dashed lines. As illustrated in FIG. 9, reference numerals 20 and 22 represent the position of the legs in an unloaded condition, while reference numerals 20' and 22' represent the position of the legs in a loaded position resulting from downward thermal expansion of the boiler 12 and/or additional weighted load due to the accumulation of bottom ash. As the boiler and buckstay 60 expands downwardly due to thermal expansion, the springs 34 resist such movement, providing a constant supporting load (as downward movement of the boiler increases, the spring load correspondingly increases).

Figure 10:
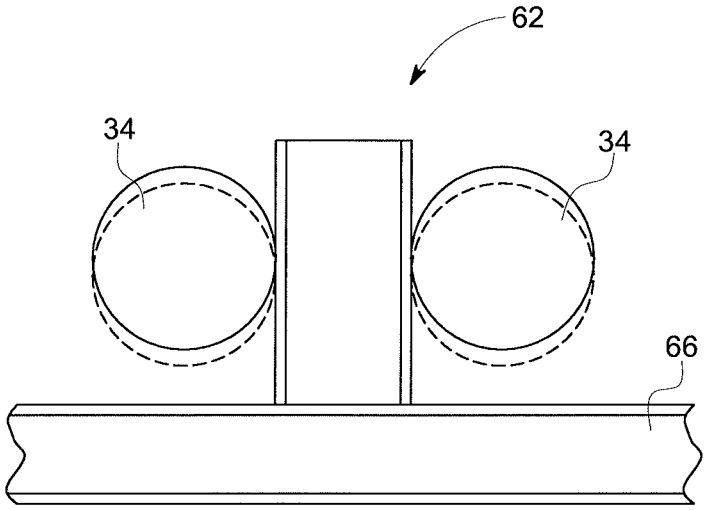
FIG. 10 is a schematic illustration of a first type of horizontal supporting tie of the support system of FIG. 1.
Figure 11:
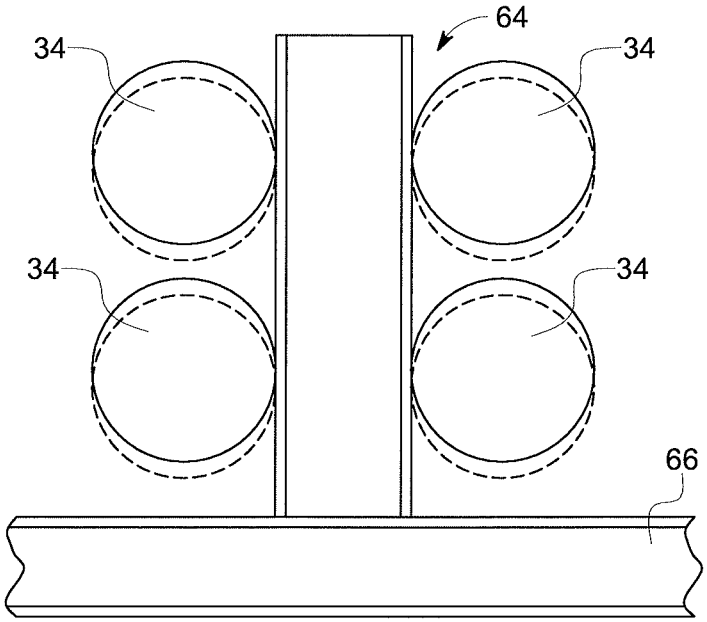
FIG. 11 is a schematic illustration of a second type of a horizontal supporting tie of the support system of FIG. 1.

In an embodiment, the support assembly 10 may also include a plurality of horizontal ties between each support assembly 14, 16 and the main boiler support structure (not shown). These ties are configured to ensure that the buckling length of each strut is equal to the length of the strut, rather than the full distance from the ground surface 18 to the buckstay 60. The ties are configured to provide horizontal, out of plane stability for each of the support assemblies 14, 16. As used herein, "out of plane" means at an angle to a plane extending through the first and second support legs 20, 22 of each support assembly 14, 16 (e.g., perpendicular to the spring axis). As illustrated in FIGS. 9 and 10, a first tie 62 is utilized to provide out of plane stability for non-nested portions of the springs 34, and as illustrated in FIGS. 9 and 11 a second tie 64 is utilized to provide out of plane stability for the nested portions of the springs 34. FIG. 10 more particularly illustrates the configuration of tie 62 as attached to the main boiler support structure 66, while FIG. 11 more particularly illustrates the configuration of tie 64 as attached to the main boiler support structure 66.

Figure 12:
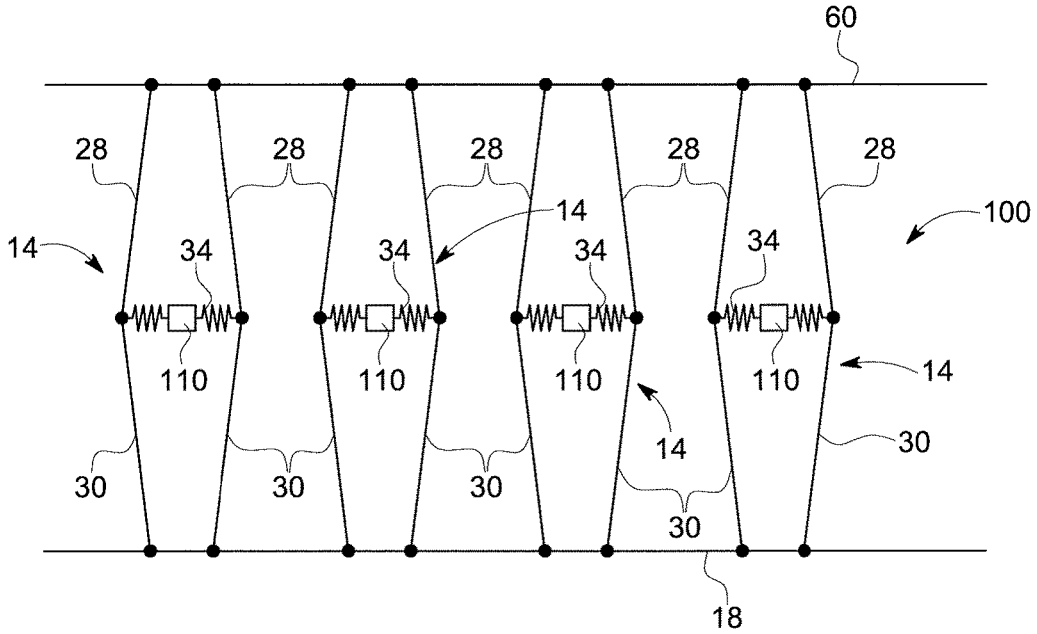
FIG. 12 is a perspective view of a support system for a boiler, according to another embodiment of the invention.

Referring finally to FIG. 12, a support system 100 according to another embodiment of the invention is illustrated. The support system 100 is similar to support system 10, where like reference numerals designate like parts. Support system 100 does not, however, utilized nested support assemblies, but rather utilized spaced-apart support assemblies 14 having a configuration identical to support assemblies 14 discussed above. As illustrated in FIG. 12, ties 110 connected to variable springs 34 and building steel (e.g., main boiler support structure) may be utilized to provide out-of-plane support for each of the assemblies 14.

The support system 10, 100 of the present invention therefore provides bottom bolstering support for a top-supported boiler, which maintains allowance for downward thermal expansion of the boiler and/or components thereof. This may be particularly desirable where a significant amount of bottom ash storage capacity is desired in top-supported boilers. The support system 10 of the invention may therefore serve to reduce the cost of buckstay systems, pressure part support straps, pressure part hangers, and building steel (which heretofore had to be redesigned to accommodate additional load due to bottom ash storage). In connection with this, a reduction in pressure part hanging straps provides more flexibility for installing observation ports, burners, over-fire wind boxes, sootblowers and the like.

In an embodiment, a support system for a boiler is provided. The system includes a plurality of support assemblies arranged intermediate a ground surface and the boiler. Each of the support assemblies include a first support leg having a lower end operatively connected to the ground surface and an upper end operatively connected to the boiler, a second support leg having a lower end operatively connected to the ground surface and an upper end operatively connected to the boiler, and at least one spring operatively connected to the first support leg and the second support leg and extending generally horizontally between the first support leg and the second support leg. In an embodiment, the first and second support legs each include a lower strut having the lower end and an upper strut having the upper end. The upper and lower struts of each support leg are pivotally connected to one another. In an embodiment, each support assembly further includes a first mounting block connecting the lower strut of the first leg to the upper strut of the first leg, and a second mounting block connecting the lower strut of the second leg to the upper strut of the second leg. The spring extends between the first mounting block and the second mounting block. In an embodiment, the spring is a pair of springs. In an embodiment, the springs are laterally offset from a plane extending through the first and second support legs. In an embodiment, the spring is a variable spring. In an embodiment, at least one of the plurality of support assemblies is nested with at least another of the plurality of support assemblies. In an embodiment, the upper ends of the first and second support legs are connected to a buckstay of the boiler. In an embodiment, the boiler is a top-supported boiler having a plurality of pressure parts suspended from a structural member located above the pressure parts. In an embodiment, the support system may include at least one tie operatively connected to the spring and to a support, the at least one tie providing horizontal, out-of-plane stability for the support assemblies.

In another embodiment, a support assembly for a boiler is provided. The support assembly includes a first support member extending generally vertically between a ground surface and the boiler, a second support member extending generally vertically between the ground surface and the boiler and spaced from the first support member, and at least one spring extending intermediate the first support member and the second support member. In an embodiment, the boiler is a top-supported boiler. In an embodiment, the first and second support members each include a lower strut having a lower end connected to the ground surface and an upper strut having an upper end connected to the boiler, wherein the upper and lower struts of each support member are pivotally connected to one another. In an embodiment, the support assembly may also include a first mounting block connecting the lower strut of the first member to the upper strut of the first member, and a second mounting block connecting the lower strut of the second member to the upper strut of the second member, wherein spring extends between the first mounting block and the second mounting block. In an embodiment, the spring is a pair of springs, and the springs may be variable springs. In an embodiment, the upper ends of the upper struts are connected to a buckstay of the boiler.

In yet another embodiment of the invention, a method for supporting a boiler load is provided. The method includes the steps of arranging a first support leg between a ground surface and the boiler, arranging a second support leg between the ground surface and the boiler, and interconnecting the first and second support leg with a variable spring. In an embodiment, the first and second support legs each include a lower strut having a lower end connected to the ground surface and an upper strut having an upper end connected to the boiler, wherein the upper and lower struts of each support leg are pivotally connected to one another. In an embodiment, the method may further include the step of placing the variable spring in compression. In an embodiment, the variable spring is a pair of variable springs. In an embodiment, the boiler is a top-supported boiler, and the boiler load results from at least one of bottom ash accumulation in the boiler and downward thermal expansion of the boiler.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. § 122, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A support system for a boiler, comprising:

a plurality of support assemblies beneath the boiler arranged between a surface and the boiler, each of the plurality of support assemblies including:

a first support leg having a lower end operatively connected to the surface and an upper end operatively connected to the boiler;

a second support leg having a lower end operatively connected to the surface a distance from the surface connection of the lower end of the first support leg, and an upper end operatively connected to the boiler a distance from the boiler connection of the upper end of the first support leg;

a mounting block in each support leg, each mounting block defining sides surrounding an open central portion; and at least one spring operatively connected to the first support leg mounting block and to the second support leg mounting block, for the at least one spring extend horizontally between the first support leg and the second support leg;

wherein each the first support leg and the second support leg includes a lower strut having the lower end and an upper strut having the upper end, and wherein each the upper strut and the lower strut of each the first support leg and the second support leg are pivotally connected to one another through the open central portion and via the mounting block in each support leg.

2. The support system of claim 1, wherein the mounting block of the first support leg pivotally connects the lower strut of the first support leg to the upper strut of the first support leg, and the mounting block of the second support leg pivotally connects the lower strut of the second support leg to the upper strut of the second support leg, and wherein the at least one spring is secured to a face of the mounting block of the first support leg and to a face of the mounting block of the second support leg.

3. The support system of claim 2, wherein the at least one spring is a pair of springs.

4. The support system of claim 2, wherein the at least one spring is laterally offset from a plane extending through the first support leg and the second support leg.

5. The support system of claim 1, wherein the at least one spring is a variable spring.

6. The support system of claim 1, wherein at least one of the plurality of support assemblies is nested with at least another of the plurality of support assemblies.

7. The support system of claim 1, wherein each the upper end of the first support leg and the upper end of the second support leg is connected to a buckstay of the boiler.

8. The support system of claim 1, wherein the boiler is suspended from a structural member located above heated parts of the boiler.

9. The support system of claim 1, further comprising at least one tie operatively connected to the at least one spring and to a support, the at least one tie providing horizontal, out-of-plane stability for a support assembly of the plurality of support assemblies.

10. A support assembly for a boiler, comprising:

a first support member arranged beneath the boiler extending between a ground surface and the boiler;

a second support member arranged beneath the boiler extending between the ground surface and the boiler and spaced from the first support member;

a mounting block in each support member, each mounting block defining sides surrounding an open central portion; and at least one spring extending between the mounting block of the first support member and the mounting block of the second support member;

wherein each the first support member and the second support member includes a lower strut having the ground surface end connected to the ground surface and an upper strut having the boiler end connected to the boiler, and wherein the upper strut and the lower strut of each the first support member and the second support member are pivotally connected to one another through the open central portion and via the mounting block in each support member.

11. The support assembly of claim 10, wherein the boiler is suspended from a structural member located above heated parts of the boiler.

12. The support assembly of claim 11, wherein the mounting block connecting the lower strut of the first support member to the upper strut of the first support member comprises a first face, the mounting block connecting the lower strut of the second support member to the upper strut of the second support member comprises a second face, and the at least one spring is secured to each the first face and to the second face to extends therebetween.

13. The support assembly of claim 12, wherein the at least one spring is a pair of springs, and wherein the pair of springs are variable springs.

14. The support assembly of claim 13, wherein each boiler end of each upper strut is connected to a buckstay of the boiler.

15. A method for supporting a load of a boiler, comprising the steps of:

arranging a first support leg beneath the boiler to extend between a surface and the boiler;

arranging a distance from the first support leg, a second support leg beneath the boiler to extend between the surface and the boiler;

arranging a mounting block in each support leg, the mounting block defining sides surrounding an open central portion; and interconnecting the first support leg and the second support leg via the mounting block in each support leg, with a spring;

wherein the first support leg and the second support leg each includes a lower strut having the ground surface end connected to the surface and an upper strut having the boiler end connected to the boiler, and wherein the upper strut and the lower strut of each the first support leg and the second support leg are pivotally connected to one another through the open central portion and via the mounting block in each support leg.

16. The method according to claim 15, further comprising the step of placing the spring in compression.

17. The method according to claim 15, wherein the spring is a pair of variable springs, the boiler is suspended from a structural member located above heated parts of the boiler, and the load of the boiler results from at least one of bottom ash accumulation within the boiler and downward thermal expansion of the boiler.

* * * * *